US007913626B1

(12) United States Patent
Reinhardt et al.

(10) Patent No.: US 7,913,626 B1
(45) Date of Patent: Mar. 29, 2011

(54) KINETIC ENERGY ABSORBER

(75) Inventors: Lyonel Reinhardt, Boonton, NJ (US); Pasquale Carlucci, Fair Lawn, NJ (US); Nicholas Payne, Hoboken, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 191 days.

(21) Appl. No.: 12/173,986

(22) Filed: Jul. 16, 2008

Related U.S. Application Data

(60) Provisional application No. 60/950,125, filed on Jul. 17, 2007.

(51) Int. Cl.
*F42B 8/12* (2006.01)
*F42B 12/00* (2006.01)
*F42B 30/00* (2006.01)

(52) U.S. Cl. ..... 102/517; 102/502

(58) Field of Classification Search ..... 102/502, 102/529, 501, 517
See application file for complete search history.

(56) References Cited

U.S. PATENT DOCUMENTS

| | | | | |
|---|---|---|---|---|
| 3,170,405 | A * | 2/1965 | Jungermann et al. | 102/529 |
| 3,485,460 | A * | 12/1969 | Mertens | 244/3.1 |
| 5,020,438 | A * | 6/1991 | Brown | 102/517 |
| 6,619,211 | B1 * | 9/2003 | Haeselich | 102/513 |
| 2008/0236435 | A1 * | 10/2008 | Danon et al. | 102/502 |

* cited by examiner

*Primary Examiner* — James S Bergin
(74) *Attorney, Agent, or Firm* — Michael C. Sachs

(57) ABSTRACT

A kinetic energy absorbing apparatus includes a body having a generally ogival exterior surface; and at least one kinetic energy absorbing structure (KEAS) extending generally rearwardly from substantially an interior surface of the body.

6 Claims, 7 Drawing Sheets

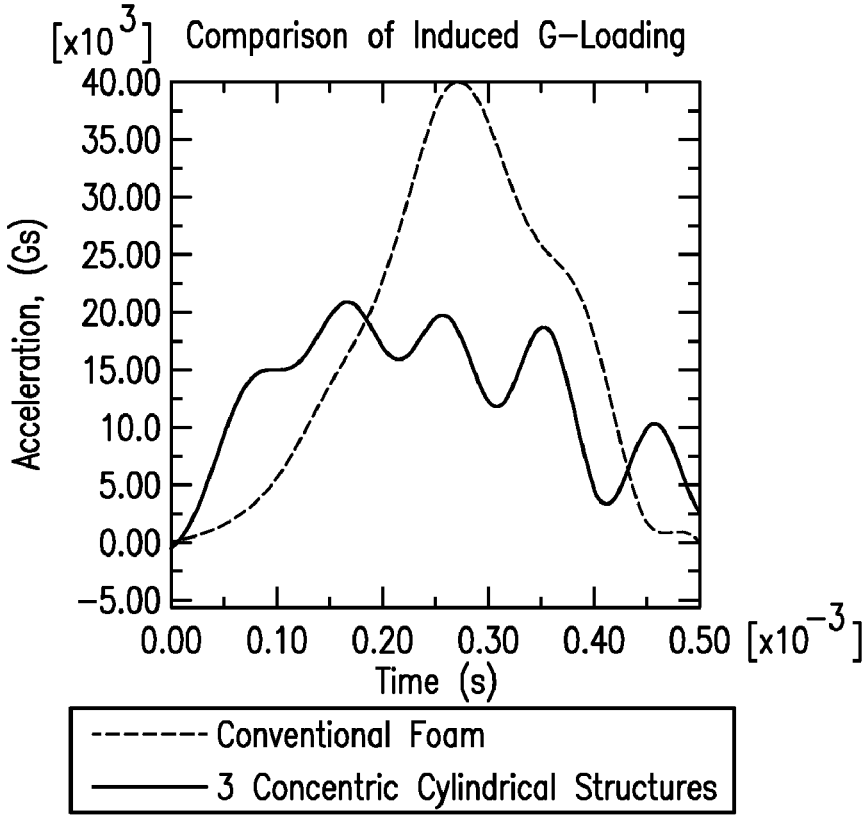
FIG−15A
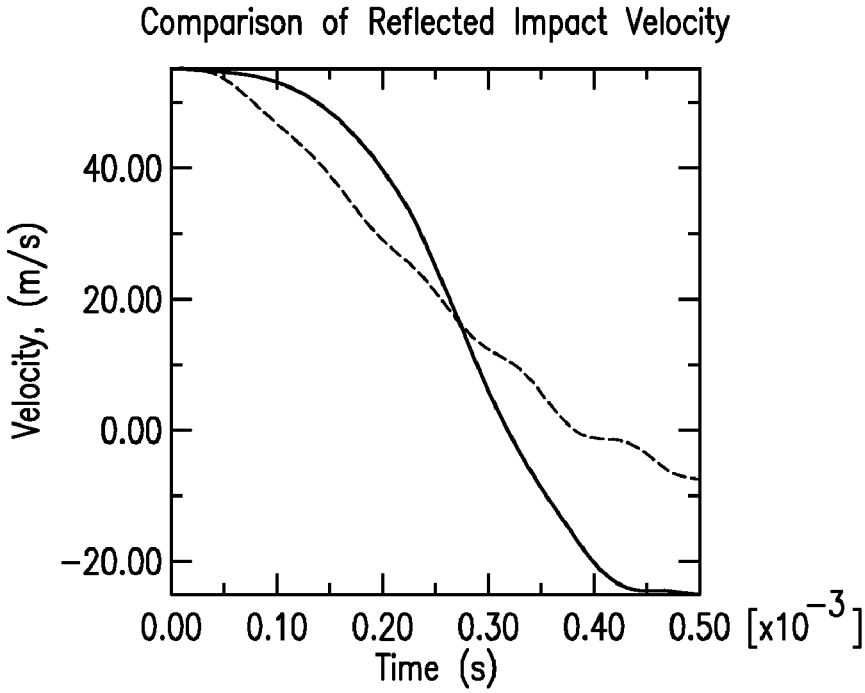
FIG−15B

KINETIC ENERGY ABSORBER

CROSS-REFERENCE TO RELATED APPLICATIONS

This application claims the benefit under 35 USC 119(e) of U.S. provisional patent application No. 60/950,125 filed Jul. 17, 2007, which application is hereby incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to kinetic energy absorbers and in particular to kinetic energy absorbers for projectiles.

Non-lethal and non-explosive projectiles are used with increasing frequency to facilitate a variety of emerging needs. These projectiles are often required to function after initial impact. Therefore, cargo and other internal components must not be damaged during the projectile's impact.

In the past, impact devices have been designed with metallic or polymer foams to provide energy absorption. The effectiveness and versatility of these types of materials are limited because foams are not easily tailored to achieve a specific response. Additionally, foam stiffness increases as compression occurs and requires large envelopes to effectively mitigate the g-levels produced during impact. Large-sized foam sections are often difficult or impractical for use on gun-launched projectiles.

SUMMARY OF THE INVENTION

It is an object of the invention to provide a kinetic energy absorber.

It is another object of the invention to provide a kinetic energy absorber for a projectile.

One aspect of the invention is a kinetic energy absorbing apparatus comprising a body having a generally ogival exterior surface; and at least one kinetic energy absorbing structure (KEAS) extending generally rearwardly from substantially an interior surface of the body. A longitudinal axis of the body and a longitudinal axis of the at least one KEAS may be substantially parallel. The at least one KEAS may comprise a plurality of KEAS. The longitudinal axis of the body and longitudinal axes of the KEAS may be substantially coincident. The KEAS may be substantially evenly spaced, radially. Aft termini of the KEAS may lie in substantially a same transverse plane, or in more than one transverse plane.

The KEAS may comprise generally hollow structures, such as, for example, tubes, hollow polyhedrons, hollow conical structures, hollow prisms, or combinations of these.

Another aspect of the invention is a projectile comprising an ogival kinetic energy absorbing apparatus, a projectile body, and a spacer. The spacer may be disposed between the projectile body and a KEAS. The spacer may include at least one forwardly extending member that meshes with a KEAS.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

FIG. 15A is a graph of impact acceleration vs. time for conventional foam and the embodiment of FIG. 5

FIG. 15B is a graph of reflected impact velocity vs. time for conventional foam and the embodiment of FIG. 5.

DETAILED DESCRIPTION OF THE PREFERRED EMBODIMENTS

The invention includes a kinetic energy absorber that mitigates the induced g-forces on a projectile, as well as the internal components of a projectile. Reducing induced g-forces on internal components increases their survivability. The invention may be designed to be sacrificial. That is, the structure may fail catastrophically, while leaving the remaining projectile and its components intact.

The present invention may comprise the nose of a projectile. The nose is mounted to the body of the projectile at the forward most point. Mounting methods may include threading, machine screws, or adhesives, depending on projectile size and function. Compared to a foam energy absorber, the present invention provides a more constant stiffness throughout the impact.

In general, a kinetic energy absorber structure (KEAS) may be a hollow structure that extends rearwardly from an interior surface of an ogive. The longitudinal axis of the KEA may be parallel to the longitudinal axis of the ogive. The diameter, size, number, wall thickness, radial spacing, and rearward extent of the KEAS may vary. The KEAS are designed to crush upon impact and mitigate g-loading on a projectile.

As impact begins, the KEAS begin to buckle successively, slowing the velocity of the projectile. As buckling continues, the KEAS will deform significantly and may rupture, thus continuing to absorb the projectile's kinetic energy. Material selection for the KEAS may be varied to provide a particular response or buckling mode, allowing the invention to be used in a variety of applications.

The KEAS may be used for commercial applications that require a single use kinetic energy absorber. Additionally, the KEAS may be used in a modular fashion to create large kinetic energy absorbing structures. The illustrated embodiments depict several exemplary variations.

Figure 1:
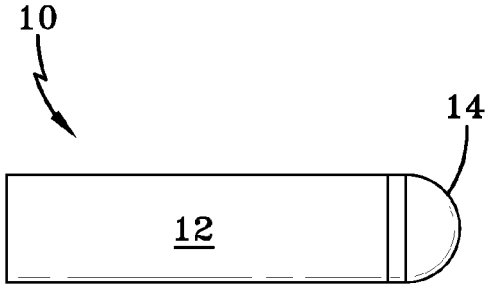
FIG. 1 is a side view of a projectile with a kinetic energy absorber.

FIG. 1 is a side view of a projectile 10 having a payload portion 12 and a nose 14. Payload portion 12 may be explosive or non-explosive. In one embodiment, the payload portion 12 may include, for example, sensors, and be non-explosive. Nose 14 may have an ogival shape. Nose 14 may include kinetic energy absorbers.

Figure 2:
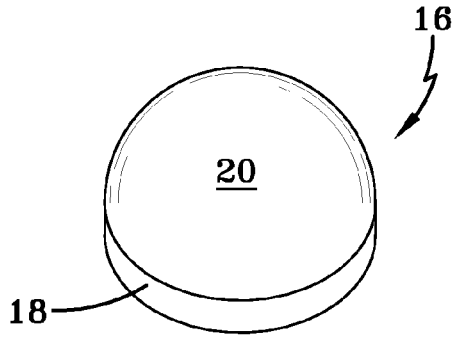
FIG. 2 is a perspective view of one embodiment of a nose in accordance with the invention.
Figure 3:
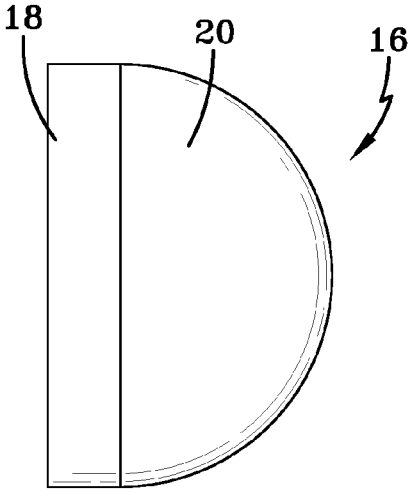
FIG. 3 is a side view of FIG. 2.
Figure 4:
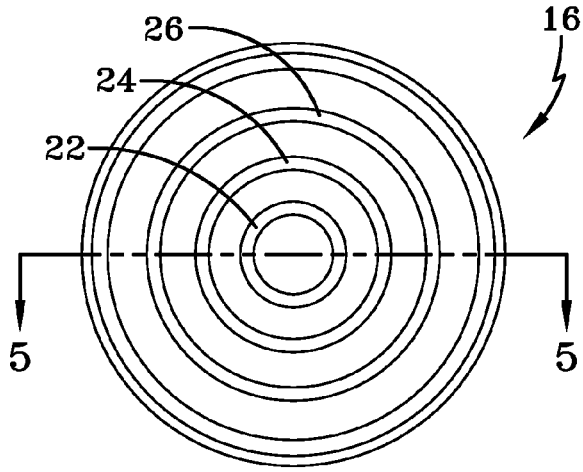
FIG. 4 is an end view of FIG. 3.
Figure 5:
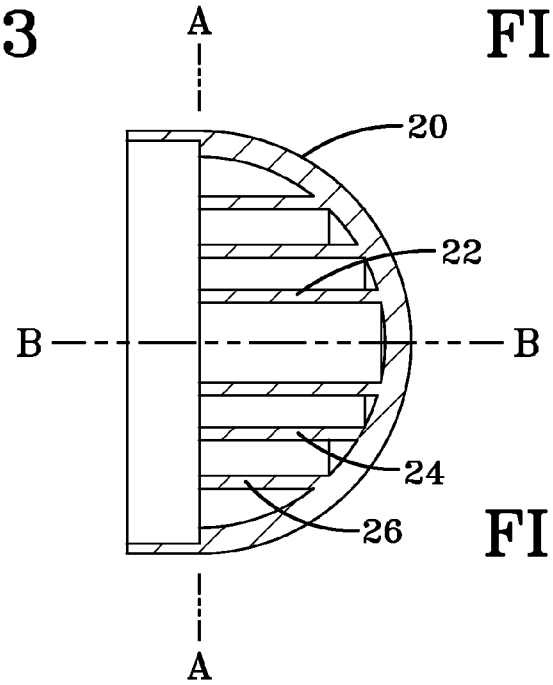
FIG. 5 is a sectional view along the line 5-5 of FIG. 4.

FIG. 2 is a perspective view of one embodiment of a nose 16 in accordance with the invention. FIG. 3 is a side view of FIG. 2. FIG. 4 is an end view of FIG. 3. FIG. 5 is a sectional view along the line 5-5 of FIG. 4. Nose 16 may include a cylindrical portion 18 and an ogival portion 20. Ogival portion 20 may have an exterior surface in the form of an ogive. Cylindrical portion 18 may be used to fix nose 16 to a payload portion of a projectile.

As best seen in FIGS. 4 and 5, nose 16 may include KEAS in the form of hollow cylinders or tubes 22, 24, 26. Tubes 22, 24, 26 may extend substantially from the interior of the ogival portion 20 rearwardly to the transverse plane A-A (FIG. 5). In FIGS. 4 and 5, each of tubes 22, 24, 26 is shown extending to transverse plane A-A. However, one of more of the tubes 22, 24, 26 may extend rearwardly further than plane A-A, or may terminate forward of plane A-A. In FIG. 5, "forward" means to the right and "rearward" means to the left.

Three tubes 22, 24 26 are shown in FIGS. 4 and 5, but there may be more or fewer than three tubes. Tubes 22, 24, 26 may be substantially concentric, that is, the longitudinal axes of the tubes and the longitudinal axis of the nose 16 may be substantially coincident with line B-B. Tubes 22, 24, 26 may be evenly radially spaced or unevenly radially spaced. The thickness of tubes 22, 24, 26 may be the same or may be different. Tubes 22, 24 26 may comprise the same or different materials, and may be integral with ogival portion 20 or not integral with ogival portion 20.

Figure 6:
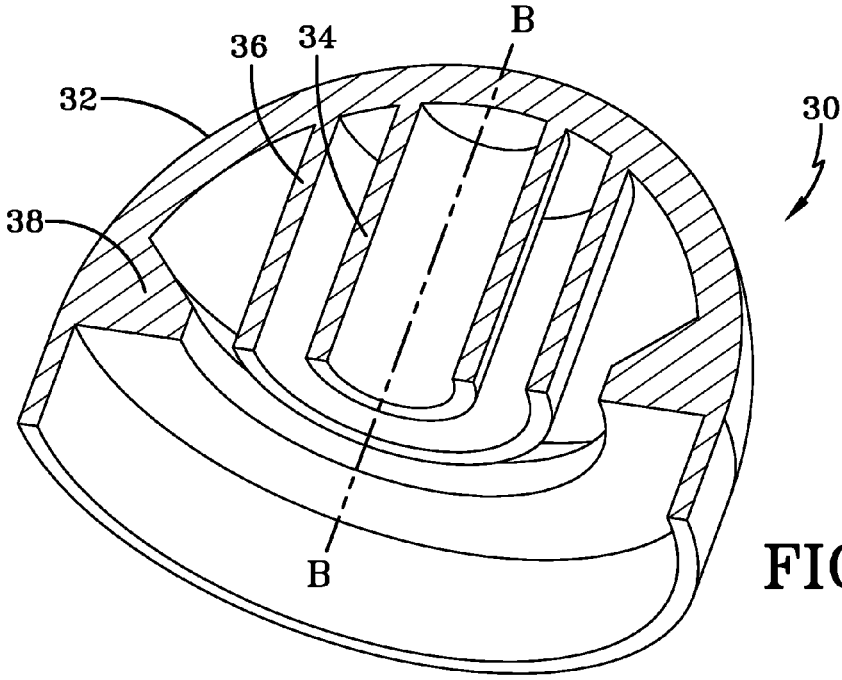
FIGS. 6-13 are perspective, partially cutaway, partially sectioned views of various embodiments of noses in accordance with the invention.

FIGS. 6-13 are perspective, partially cutaway, partially sectioned views of various embodiments of noses in accordance with the invention. FIG. 6 shows a nose 30 comprising an ogival portion 32 and KEAS 34, 36, 38. KEAS 34, 36 may be in the form of tubes and KEAS 38 may have a conical structure. KEAS 34, 36, 38 may be concentric with the longitudinal axis B-B of nose 30.

Figure 7:
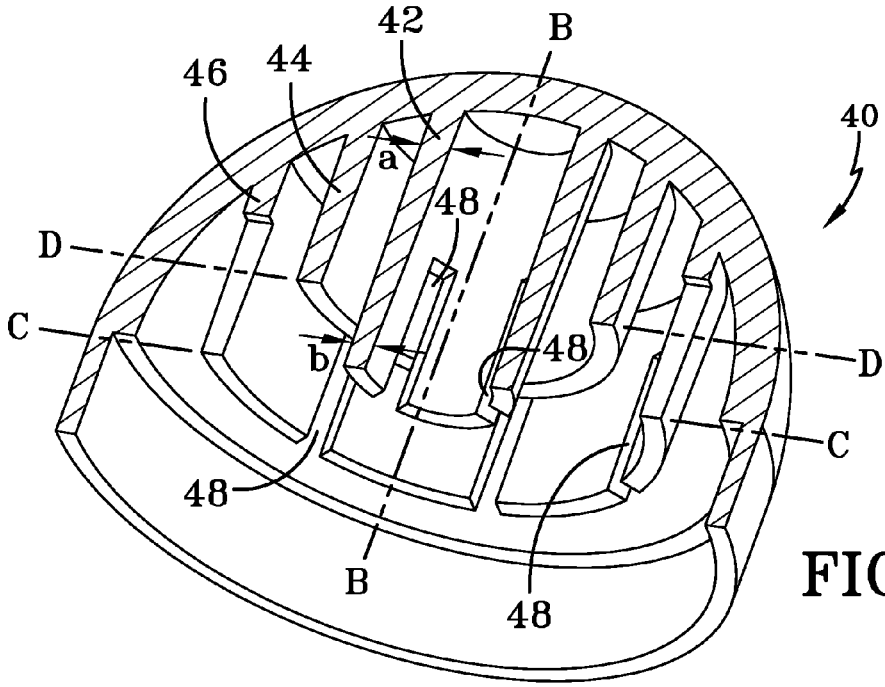

FIG. 7 shows a nose 40 comprising tubular KEAS 42, 44, 46. Wall thicknesses of the KEAS 42, 44, 46 may vary, whether the KEAS is tubular, conic, polyhedral or otherwise. For example, the wall thickness of KEAS 42 tapers rearwardly from thickness a to thickness b. The wall thickness may also increase rearwardly, if desired. KEAS 42, 44, 46 may include one or more slots 48 formed therein. Slots 48 may begin at the aft terminus of the KEAS and extend forwardly. Slots may be formed in a KEAS of any form, whether tubular, conic, polyhedral or otherwise.

FIG. 7 shows that the KEAS 42, 44, 46 need not terminate in a common transverse plane. For example, KEAS 44 terminates in transverse plane D-D and KEAS 46 terminates in transverse plane C-C. KEAS of any form, whether tubular, conic, polyhedral or otherwise, may terminate in the same or different transverse planes.

The KEAS 42, 44, 46 shown in FIG. 7 are generally tubular, however, they may also be, for example, conic structures, polyhedrons comprising three or more sides, or combinations of these structures. KEAS 42, 44, 46 may be concentric with axis B-B of nose 40

Figure 8:
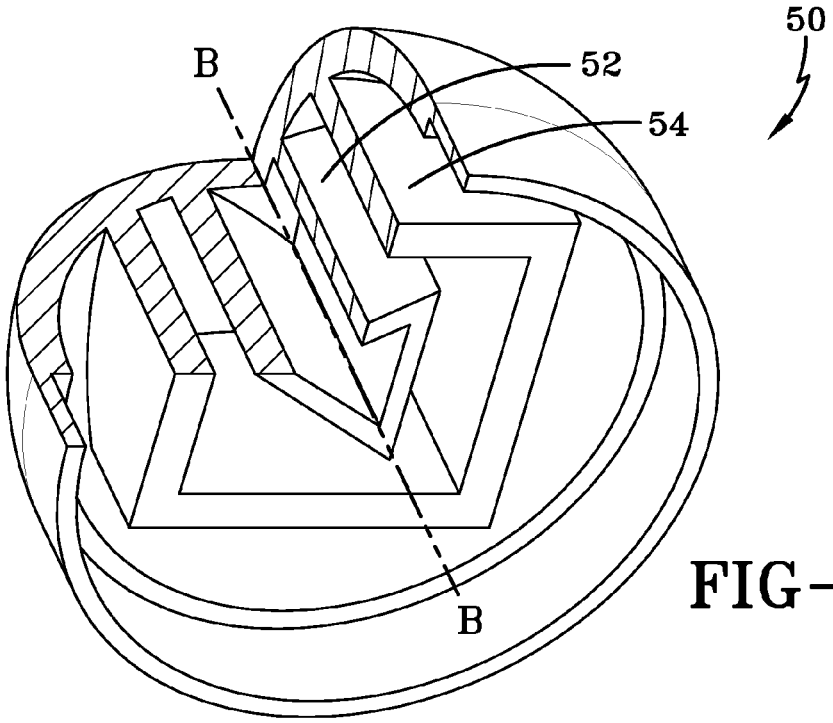

FIG. 8 shows a nose 50 comprising KEAS 52, 54. KEAS 52, 54 may be hollow polyhedrons. In FIG. 8, KEAS 52 may be a hollow triangular prism and KEAS 54 may be a hollow square prism. KEAS 52, 54 may be concentric with axis B-B of nose 50

Figure 9:
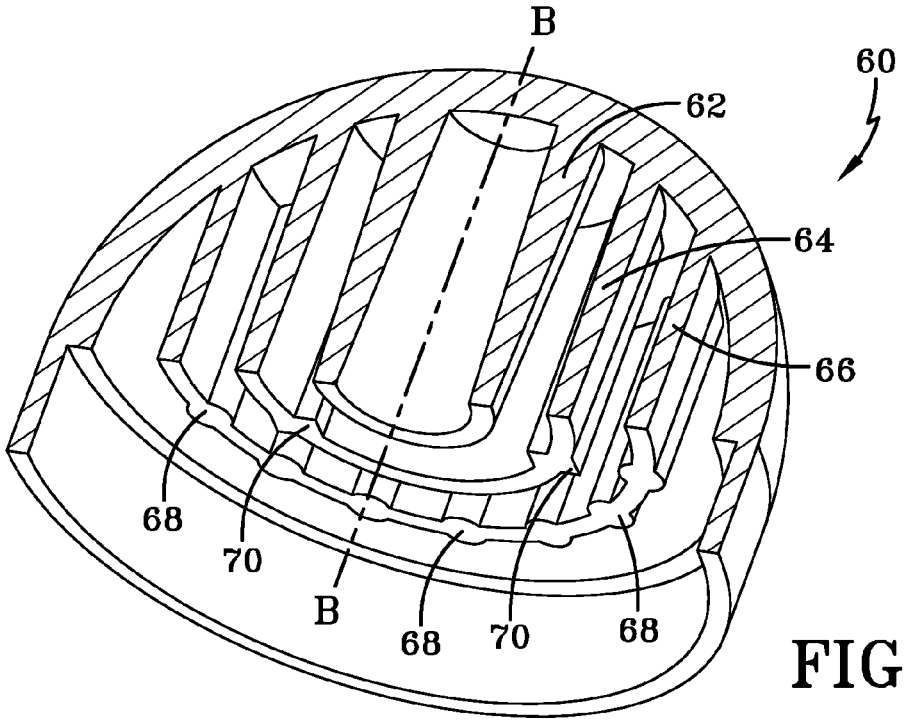

FIG. 9 shows a nose 60 comprising KEAS 62, 64, 66 in the form of tubes. KEAS 62, 64 may have tapering wall thicknesses. KEAS 62, 64, 66 may be concentric with axis B-B of nose 60. KEAS 64, 68 may have longitudinal ribs 68, 70 formed therein. Ribs 68 may be generally rounded and ribs 70 may be generally triangular in section. Ribs of any shape may be used. Ribs may be included with KEAS of any geometry.

Figure 10:
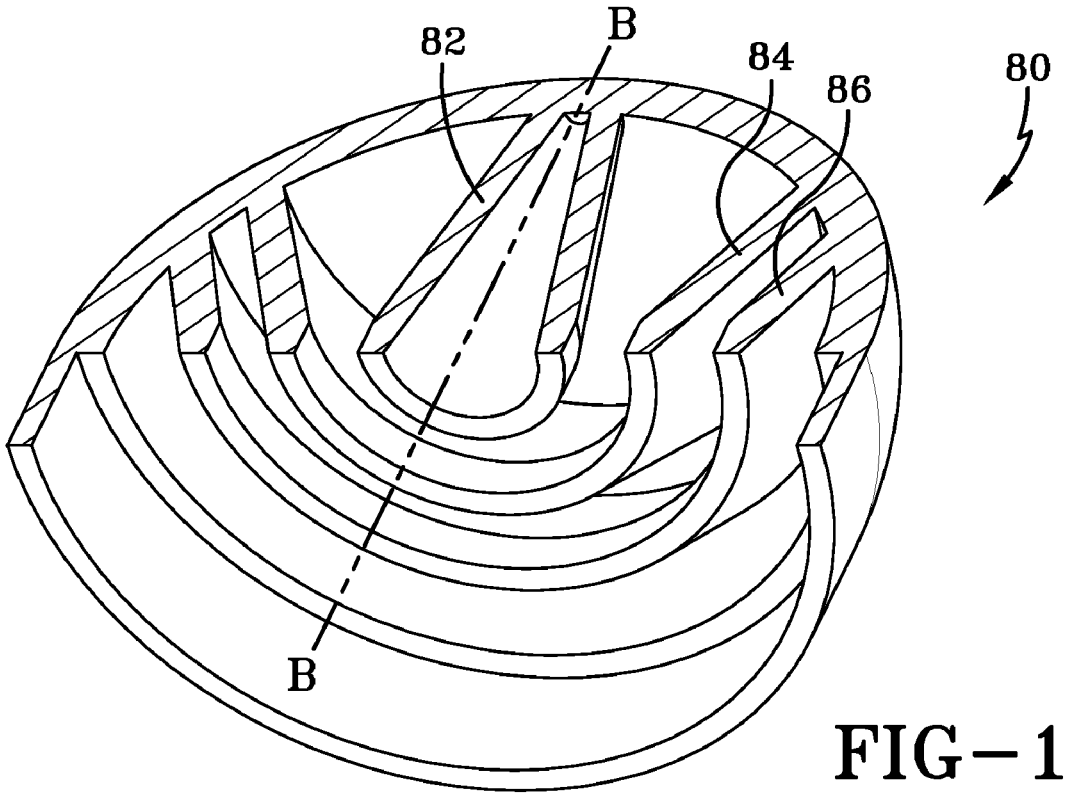

FIG. 10 shows a nose 80 comprising KEAS 82, 84, 86. KEAS 82, 84, 86 may comprise hollow conical structures, as shown. KEAS 82, 84, 86 may be concentric with axis B-B of nose 80.

Figure 11:
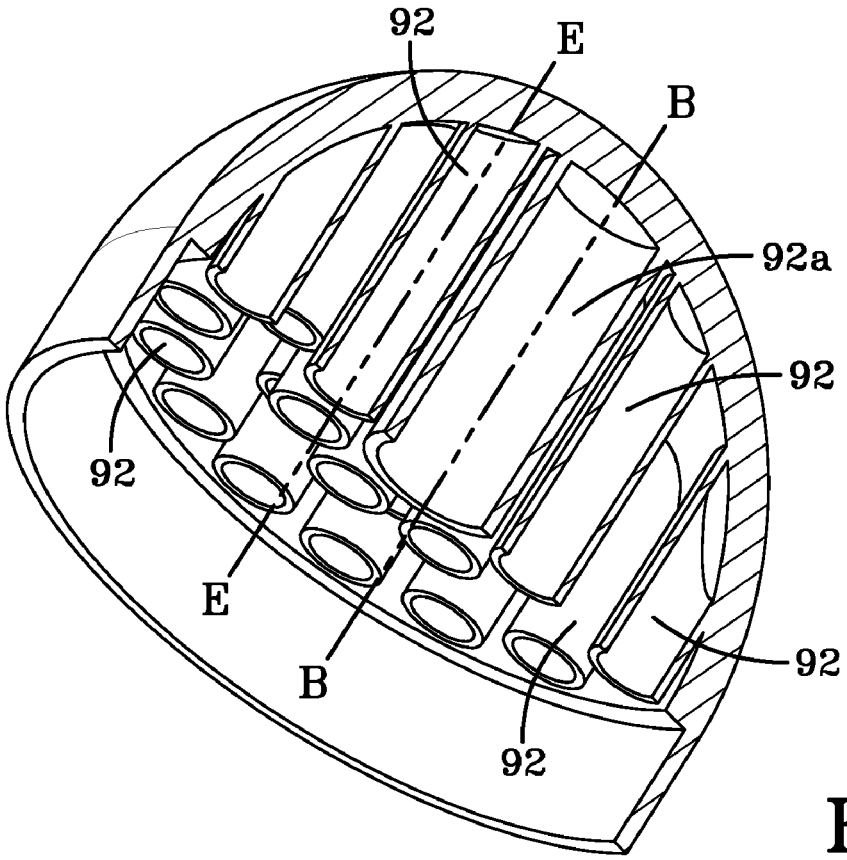

FIG. 11 shows a nose 90 comprising a plurality of tubular KEAS 92, 92*a*. KEAS 92, 92*a* may not be concentric. The longitudinal axes E-E of the KEAS 92 may be substantially parallel to the longitudinal axis B-B of nose 90. The axis of the KEAS 92*a* need not, but may be, coincident with the axis B-B of nose 90.

Figure 12:
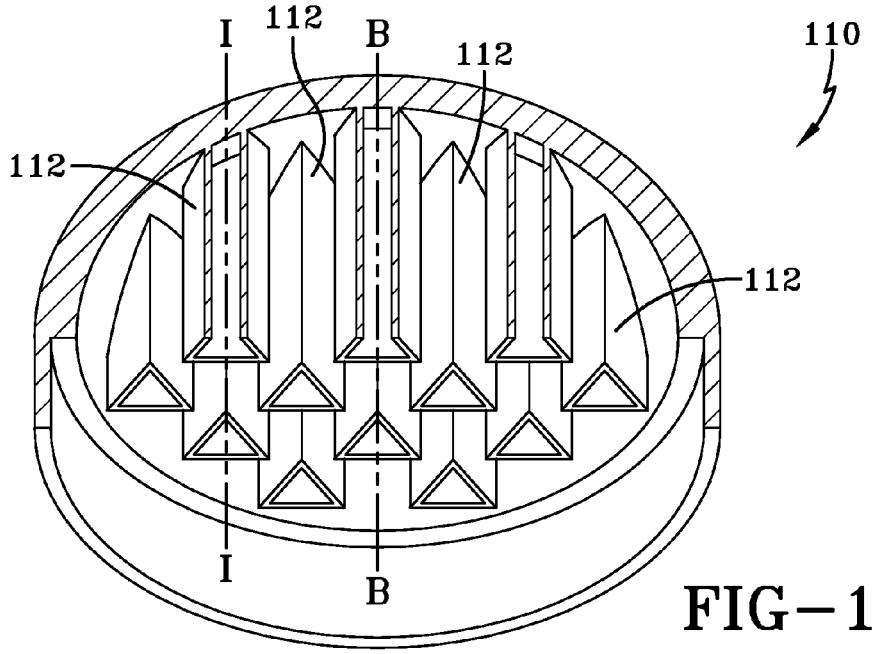

FIG. 12 shows a nose 110 comprising a plurality of KEAS 112. KEAS 112 may be hollow polyhedrons, such as hollow prisms with three or more sides. Longitudinal axes I-I of KEAS 112 may be substantially parallel to axis B-B of nose 110.

Figure 13:
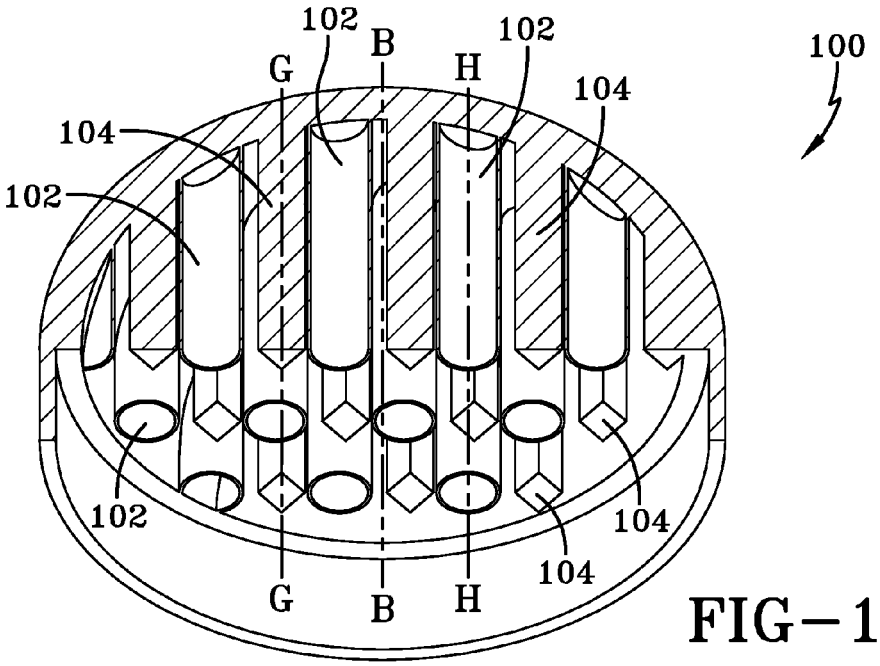

FIG. 13 shows a nose 100 comprising a plurality of KEAS 102, 104. KEAS 102 may be tubes. KEAS 104 may be polyhedrons having three or more sides, or may be cylinders. Longitudinal axes G-G of KEAS 104 and longitudinal axes H-H of KEAS 102 may be substantially parallel to axis B-B of nose 100. KEAS 104 may be solid, rather than hollow.

Figure 14:
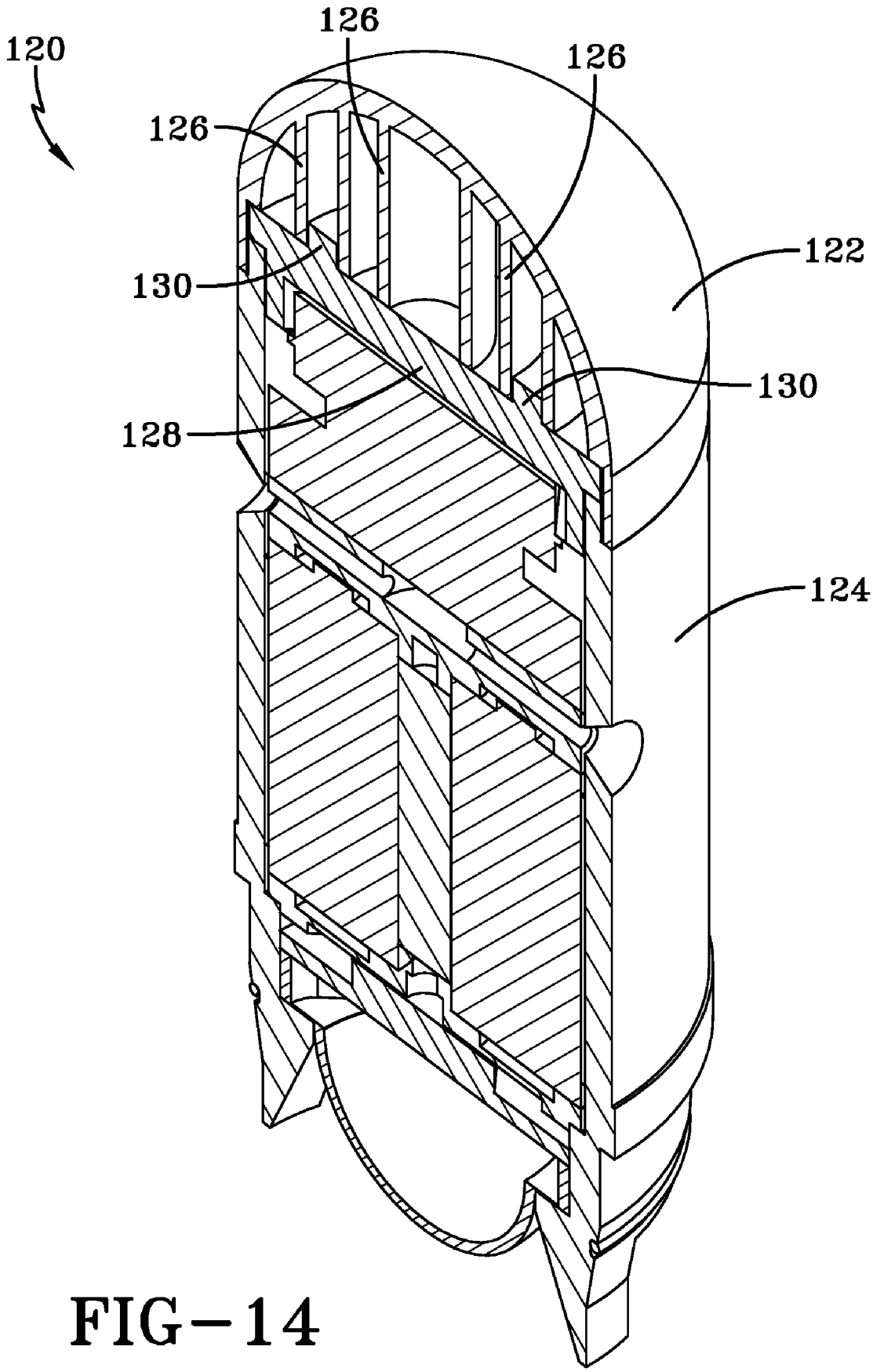
FIG. 14 is a perspective, partially cutaway, partially sectioned view of a projectile.

FIG. 14 is a perspective, partially cutaway, partially sectioned view of a projectile 120. Projectile 120 may comprise a body 124 and an ogival nose 122. Nose 122 may include a plurality of KEAS 126. A spacer 128 may comprise one or more forwardly extending members 130 that mesh or mate with the KEAS 126. In general, the rear portions of the KEAS (whether tubes, polyhedrons, conical structures, or otherwise, and whether concentric or not concentric) may be used to mate with a spacer 128. The spacer 128 may help to interlock the ogive 122 to the body 124 and thereby prevent sideways displacement that may occur with glancing or angled impacts.

A Finite Element Analysis (FEA) was conducted to determine the dynamic response of the invention and of conventional foam. FIGS. 15A and 15B show the predicted FEA results for induced G-loading (FIG. 15A) and reflected impact velocity (FIG. 15B) for the embodiment shown in FIGS. 2-5, and for conventional foam. The results show the invention may achieve a reduction in induced G-loading of about 50% compared to conventional foam. Additionally, the reduction in reflected velocity of about 60% shows that the invention absorbs more kinetic energy than conventional foam.

A prototype of the embodiment of FIGS. 2-5 was built and tested. On board telemetry was used to collect acceleration data. Compared to conventional foam, the invention showed about a 40% reduction in peak G-load, from 40,000 Gs to 25,000 Gs.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A projectile which includes a kinetic energy absorbing apparatus, said projectile comprising a projectile body having a generally ogival exterior surface and at least one kinetic energy absorbing structure (KEAS) said KEAS comprising a plurality of constituent at least one KEAS extending generally rearwardly from substantially an interior surface of the projectile body, wherein a longitudinal axis of the projectile body and a longitudinal axis of the at least one KEAS are substantially parallel, said projectile further comprising a spacer, the spacer being disposed between the projectile body and the at least one KEAS, the spacer including at least one forwardly extending member that meshes with the at least one KEAS, wherein such KEAS comprise one or more of generally hollow: tubes, polyhedrons, and conical structures.

2. The apparatus of claim 1 wherein wall thicknesses of the KEAS are of the same thickness.

3. The apparatus of claim 1 wherein wall thicknesses of the KEAS vary from one KEAS to another KEAS.

4. The apparatus of claim 1 wherein a wall thickness of a KEAS varies.

5. The apparatus of claim 1 wherein a KEAS includes a longitudinal rib.

6. The apparatus of claim 1 wherein a KEAS includes at least one slot, the slot beginning at an aft terminus of the KEAS and extending forwardly.

* * * * *